US005650690A

United States Patent [19]

Haven

[11] Patent Number: 5,650,690

[45] **Date of Patent: *Jul. 22, 1997**

[54] BACKPLATE OF FIELD EMISSION DEVICE WITH SELF ALIGNED FOCUS STRUCTURE AND SPACER WALL LOCATORS

[75] Inventor: Duane A. Haven, Cupertino, Calif.

[73] Assignee: Candescent Technologies, Inc., San Jose, Calif.

[ * ] Notice: The term of this patent shall not extend beyond the expiration date of Pat. No. 5,528,103.

[21] Appl. No.: 343,074

[22] Filed: Nov. 21, 1994

[51] Int. Cl.[6] ..... H01J 29/18

[52] U.S. Cl. ..... 313/422; 313/307; 313/495; 313/497; 313/310; 313/292; 313/461

[58] Field of Search ..... 313/307, 238, 313/422, 495, 309, 310, 336, 351, 292, 283, 288, 496, 461, 463, 466

[56] References Cited

U.S. PATENT DOCUMENTS

| | | | |
|---|---|---|---|
| 4,020,381 | 4/1977 | Oess et al. | 313/351 X |
| 4,163,949 | 8/1979 | Shelton | 313/309 X |
| 4,174,523 | 11/1979 | Marlowe et al. | 313/422 X |
| 4,577,133 | 3/1986 | Wilson | 313/422 X |
| 4,618,801 | 10/1986 | Kakino | 313/495 |
| 4,622,492 | 11/1986 | Barten | 313/422 |
| 4,804,887 | 2/1989 | Miyama et al. | 313/422 X |
| 4,857,799 | 8/1989 | Spindt et al. | 313/495 |
| 4,887,000 | 12/1989 | Yamazaki et al. | 313/422 |
| 4,900,981 | 2/1990 | Yamazaki et al. | 313/422 |
| 5,003,219 | 3/1991 | Muragishi et al. | 313/422 X |
| 5,063,327 | 11/1991 | Brodie et al. | 313/495 X |
| 5,160,871 | 11/1992 | Tomii et al. | 313/422 X |
| 5,170,100 | 12/1992 | Shichao et al. | 313/422 |
| 5,220,240 | 6/1993 | Ohoshi et al. | 313/422 |
| 5,227,691 | 7/1993 | Murai et al. | 313/422 |
| 5,229,691 | 7/1993 | Shichao et al. | 313/422 X |
| 5,315,207 | 5/1994 | Hoeberechts et al. | 313/446 X |
| 5,394,066 | 2/1995 | Leroux | 313/422 X |
| 5,528,103 | 6/1996 | Spindt et al. | 313/497 |

FOREIGN PATENT DOCUMENTS

| | | |
|---|---|---|
| 0 436 997 A1 | 7/1991 | European Pat. Off. . |
| 0 464 938 A1 | 1/1992 | European Pat. Off. . |
| 0 496 450 A1 | 7/1992 | European Pat. Off. . |
| 0 580 244 A1 | 1/1994 | European Pat. Off. . |
| 93/18536 | 9/1993 | WIPO . |

*Primary Examiner*—Ashok Patel
*Attorney, Agent, or Firm*—Wilson Sonsini Goodrich & Rosati

[57] ABSTRACT

A backplate structure for a field emission display includes a transparent backplate substrate, a plurality of opaque electrodes, a plurality of field emitters geometrically located in the opaque electrodes, and a focusing electrode. The focusing electrode has an exterior surface with a conductive layer disposed substantially over the exterior surface, and the focusing electrode is electrically isolated from the opaque electrodes. The faceplate structure can further include a plurality of transparent electrodes that are orthogonal to the opaque electrodes.

17 Claims, 13 Drawing Sheets

BACKPLATE OF FIELD EMISSION DEVICE WITH SELF ALIGNED FOCUS STRUCTURE AND SPACER WALL LOCATORS

CROSS-REFERENCE TO RELATED APPLICATIONS

This application is related to Ser. Nos. 08/188,856, filed Jan. 29, 1994, now U.S. Pat. No. 5,477,105; filed Feb. 1, 1993, now allowed and U.S. Pat. No. 5,424,605, all assigned to the same assignee as this application. This application cross references co-pending application entitled "Field Emission Device With Internal Structure For Aligning Phosphor Pixels With Corresponding Field Emitters"; Ser. No. 08/343,875 and allowed application entitled "Faceplate For Field Emission Display Including Wall Gripper Structures"; Ser. No. 08/343,803, both filed on the same day as this application.

BACKGROUND

1. Field of the Invention

This invention relates generally to the backplate of a field emission display, and more particularly to a self aligned focusing grid for field emitters that emit electrons to corresponding phosphor pixels. Further, this invention relates to a locator formed on an interior surface of the backplate for receiving a spacer wall.

2. Description of the Related Art

Field emission devices include a faceplate, a backplate and connecting walls around the periphery of the faceplate and backplate, forming a sealed vacuum envelope. Generally in field emission devices, the envelope is held at vacuum pressure, which in the case of CRT displays is about $1\times10^{-7}$ torr or less. The interior surface of the faceplate is coated with light emissive elements, such as phosphor or phosphor patterns, which define an active region of the display. Cathodes, (field emitters) located adjacent to the backplate, are excited to release electrons which are accelerated toward the phosphor on the faceplate, striking the phosphor, and causing the phosphor to emit light seen by the viewer at the exterior of the faceplate. Emitted electrons for each of the sets of the cathodes are intended to strike only certain targeted phosphors. There is generally a one-to-one correspondence between each emitter and a phosphor.

Flat panel displays are used in applications where the form-factor of a flat display is required. These applications are typically where there are weight constraints and the space available for installation is limited, such as in aircraft or portable computers.

A certain level of color purity and contrast are needed in field emission devices. Contrast is the difference between dark and bright areas. The higher the contrast, the better. The parameters of resolution, color-purity and contrast in a flat cathodeluminescent display depend on the precise communication of a selected electron emitter with its corresponding phosphor pixels. Additionally, high picture brightness (lumens), requires either high power consumption or high phosphor efficiency (lumens/watt).

High power consumption in many applications is not desirable. Efficiency for many phosphors increases as the operating anode voltage increases; and the required operating brightness can be achieved with lower power consumption at high voltage, as illustrated in FIG. 1. In order to satisfactorily operate at high anode voltages, e.g., 4 kV or higher, the backplate containing the emitter array must be spatially separated from the faceplate, containing the phosphor pixels, by a distance sufficient to prevent unwanted electrical events between the two. This distance, depending on the quality of the vacuum and the topography of the substrates, is typically greater than about 2 mm.

With the constraints of faceplate and backplate glass area and thickness, the vacuum envelope is unable to withstand 1 atmosphere or greater external pressure without inclusion of the spacer walls. If the spacer walls are not included then the faceplate and backplate can collapse. In rectangular displays, having greater than approximately a 1 inch diagonal, the faceplate and backplate are particularly susceptible to this type of mechanical failure due to their high aspect ratio, which is defined as the larger dimension of the display divided by the thickness of the faceplate or backplate. The use of spacer walls in the interior of the field emission device substantially eliminates this mechanical failure.

The use of spacer walls has been reported in U.S. Pat. Nos. 4,900,981; 5,170,100; EPO 464 938 A1; EPO 436 997 A1; EPO 580 244 A1; and EPO 496 450 A1.

The faceplates and backplates for the desired flat, light portable display are typically about 1 mm thick. To avoid seeing the spacer walls at the exterior of the faceplate, the spacer walls should be hidden behind a suitable structure such as a black matrix.

The angular distribution of electrons from certain types of electron emitters is such that there is substantial emission at field emitter cone half angles greater than about 45 degrees. In devices where the electron emitter is located 2 mm from the corresponding picture element, the projection electrons from emitter will illuminate a disc with an area greater than 4 mm in diameter.

A ten inch diagonal color display used in portable computers, at VGA color resolution requires that the area illuminated by each electron emission source not exceed 0.00417 inches in diameter to maintain purity of color. In these high energy phosphor displays it is necessary to restrict and focus the electron beam that is generated. For this VGA display, the maximum locational tolerance for the position of the electron beam at the picture element is 0.0005 inches. This is one-half the width of a column guard band in the black matrix surrounding each color sub-pixel.

The total tolerance budget for location of the electron beam relative to its corresponding pixel is the summation of positional errors in the geometrical alignment of the substrate containing the electron emitters to the faceplate containing the phosphor sub-pixels.

Of the phosphor to black matrix, and the field emitter to focus alignment, the latter is the most critical because deflection of the electron beam by the focus grid is a function of the electric field generated by the focus grid. The electron-optical properties of the focus grid are such that any misalignment of the emitters in the focus grid will be amplified, as seen in the position of the electron beam on the phosphor coated faceplate.

It would be desirable to minimize misalignment of the electron beam and the consequential loss of color purity and make the principal axis of the electron beam coaxial with the focusing lens. It would also be desirable to create a focus electrode that is self aligned to the field emitter. It would be further desirable to provide a self aligned focus grid for a field emission display.

SUMMARY

Accordingly, it is an object of the invention to minimize misalignment of the electron beam in a field emission display and the consequential loss of color purity.

Another object of the invention is to create a focus electrode in a field emission display that is self aligned to the field emitter.

A further object of the invention is to provide a self aligned focus grid in a field emission display.

The backplate structure includes a plurality of transparent electrodes that are orthogonal to the opaque electrodes. The focusing electrode has an electrically conductive layer positioned substantially over its exterior surface. The focusing electrode is aligned to the opaque electrodes, and electrically isolated from the transparent and opaque electrodes. The emitters are built up on the lower transparent electrode and located in an opaque gate.

Additionally, the backplate structure can include a focusing grid with an electrically conductive layer formed on substantially all of the exterior surface of the focusing grid. The focusing grid is aligned to the opaque and transparent electrodes and electrically isolated from them. One or more spacer wall locators can be formed on the interior side of the backplate substrate, and one or more alignment fiducials formed on an opaque or transparent electrode.

A method for forming a backplate structure for a field emission device includes providing a backplate with an exterior surface and an interior surface. The backplate is made of a transparent substrate, a plurality of opaque electrodes, and a plurality of field emitters formed on the opaque electrodes. A photo patternable material is applied to substantially the entire internal surface of the backplate. The internal surface is exposed to UV radiation through the exterior surface. The photo patternable material is developed and cured. The cured material is then coated with an electrically conductive layer. Finally, the backplate is baked to create a focusing electrode that is electrically isolated from the opaque electrodes. The shrinkage of the electrode breaks the continuity of the electrically conductive layer.

DESCRIPTION OF THE DRAWINGS

FIG. 4(*b*) is an exploded view of the field emission display with fiducials formed in the faceplate substrate and the focus grid.

FIG. 6(*b*) illustrates a perspective view, as in FIG. 6(*a*), with the spacer wall being introduced into the receiving trench.

FIG. 7(*b*) is a perspective view of the faceplate interior side with spacer walls positioned in receiving trenches formed in the black matrix.

DETAILED DESCRIPTION OF THE PREFERRED EMBODIMENTS

In the following description, embodiments of the invention are described with respect to a self aligned focus structure on the backplate of a field emission display. The backplate has an interior surface where locator structures are formed to receive and locate a spacer wall relative to the field emitters.

Herein, a flat panel display is a display in which a faceplate and backplate are substantially parallel, and the thickness of the display is small compared to the thickness of a conventional deflected-beam CRT display. The thickness of the display is measured in a direction substantially perpendicular to the faceplate and backplate. Often the thickness of a flat panel display is substantially less than about 2.0 inches, and in one embodiment it is about 4.5 to 7.0 min.

Figure 1:
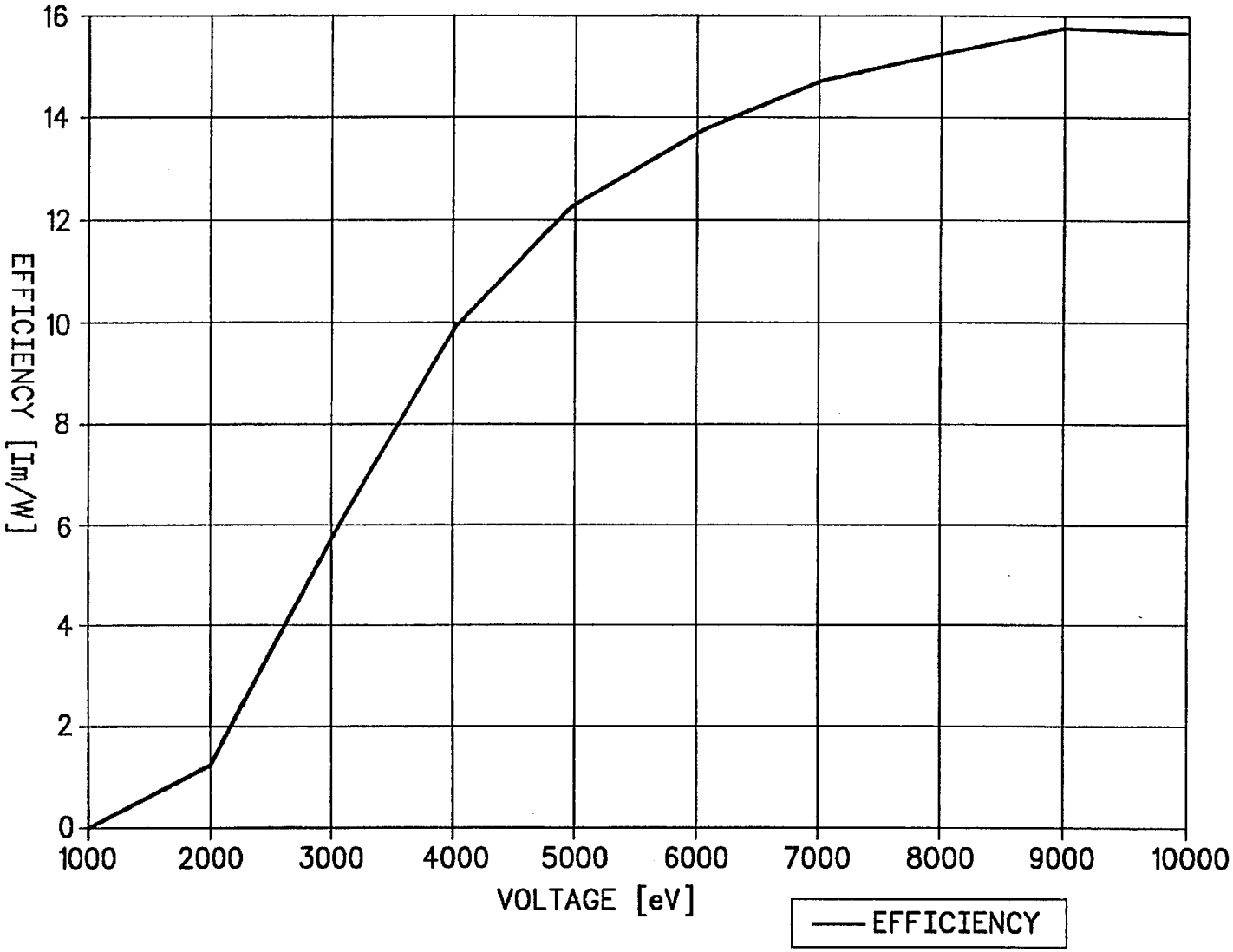
FIG. 1 is a graph of a curve of luminous efficiency verses voltage for a representative cathode luminescent phosphor.
Figure 2:
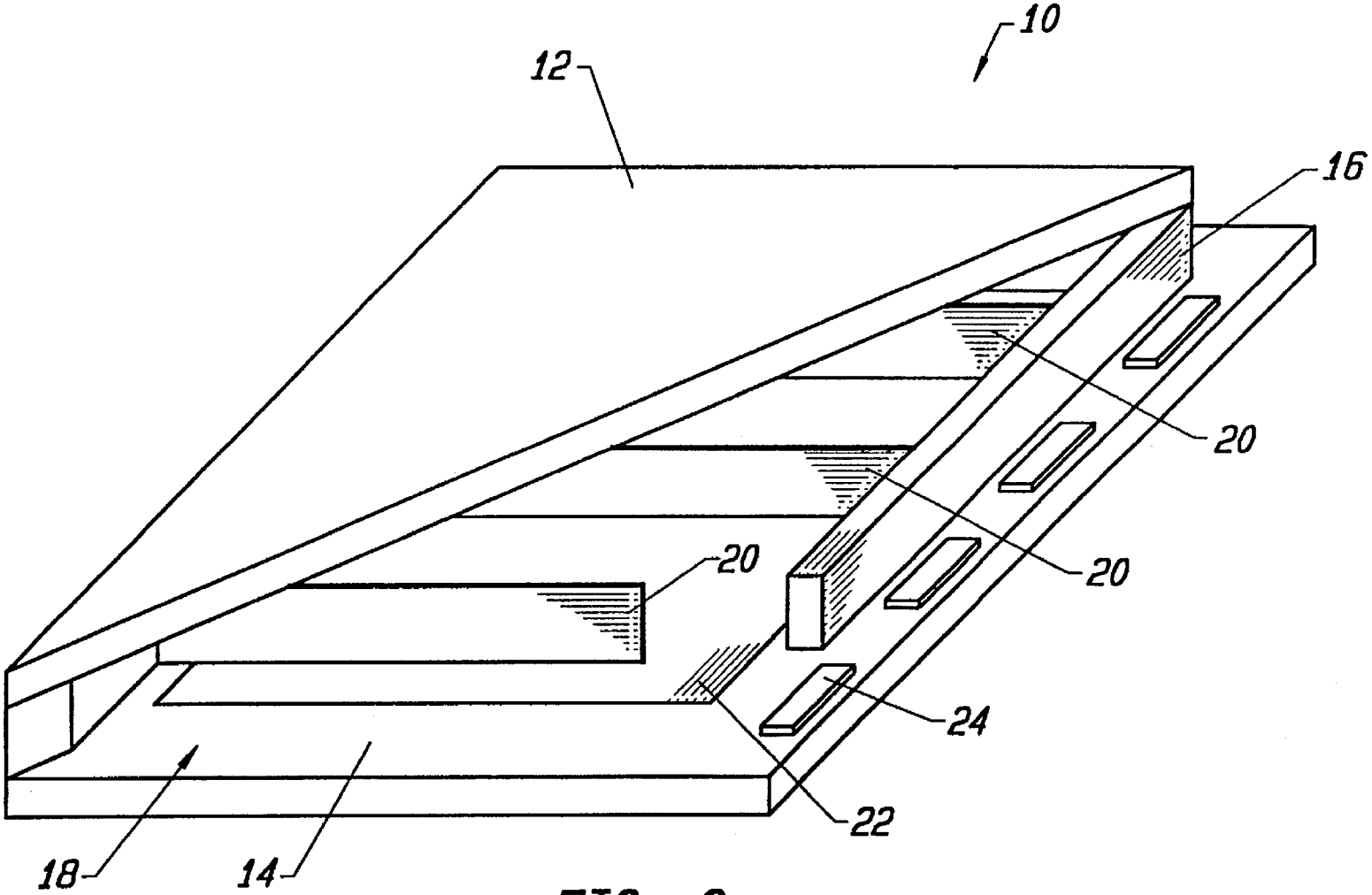
FIG. 2 is a perspective view of a field emission display.

Referring now to FIG. 2, a flat panel display 10 includes a faceplate 12, backplate 14 and side walls 16, which together form a sealed envelope 18 that is held at vacuum pressure, e.g., approximately $1\times10^{-7}$ torr or less. One or more spacer walls 20 support faceplate 12 against backplate 14. Spacer walls 20 can include electrodes positioned along their longitudinal length. For purposes of this disclosure, spacer walls 20 include walls, posts and wall segments.

Further, spacer walls 20 have a sufficiently small thickness so that they provide minimal interference with the operation of flat panel display 10, particularly the cathodes (field emitters) and phosphors of the device. Spacer walls 20 are made of a ceramic, glass, glass-ceramic, ceramic tape, ceramic reinforced glass, devitrified glass, amorphous glass in a flexible matrix, metal with electrically insulating coating, bulk resistivity materials such as a titanium aluminum chromium oxide, high-temperature vacuum compatible POLYIMIDES or insulators such as silicon nitride. Spacer walls 20 have a thickness of about 20 to 60 μm, and a center-to-center spacing of about 8 to 10 mm. Spacer walls 20 provide internal supports for maintaining spacing between faceplate 12 and backplate 14 at a substantially uniform value across the entire active area of the display at an interior surface of faceplate 12.

A plurality of field emitters 22 are formed on a surface of backplate 14 within envelope 18. For purposes of this disclosure, field emitters 22 can include a plurality of field emitters or a single field emitter. Row and column electrodes control the emission of electrons from field emitters 22. The electrons are accelerated toward a phosphor coated interior surface of faceplate 12. Integrated circuit chips 24 include driving circuitry for controlling the voltage of the row and column electrodes so that the flow of electrons to faceplate 12 is regulated. Electrically conductive traces are used to electrically connect circuitry on chips 24 to the row and column electrodes.

Figure 3:
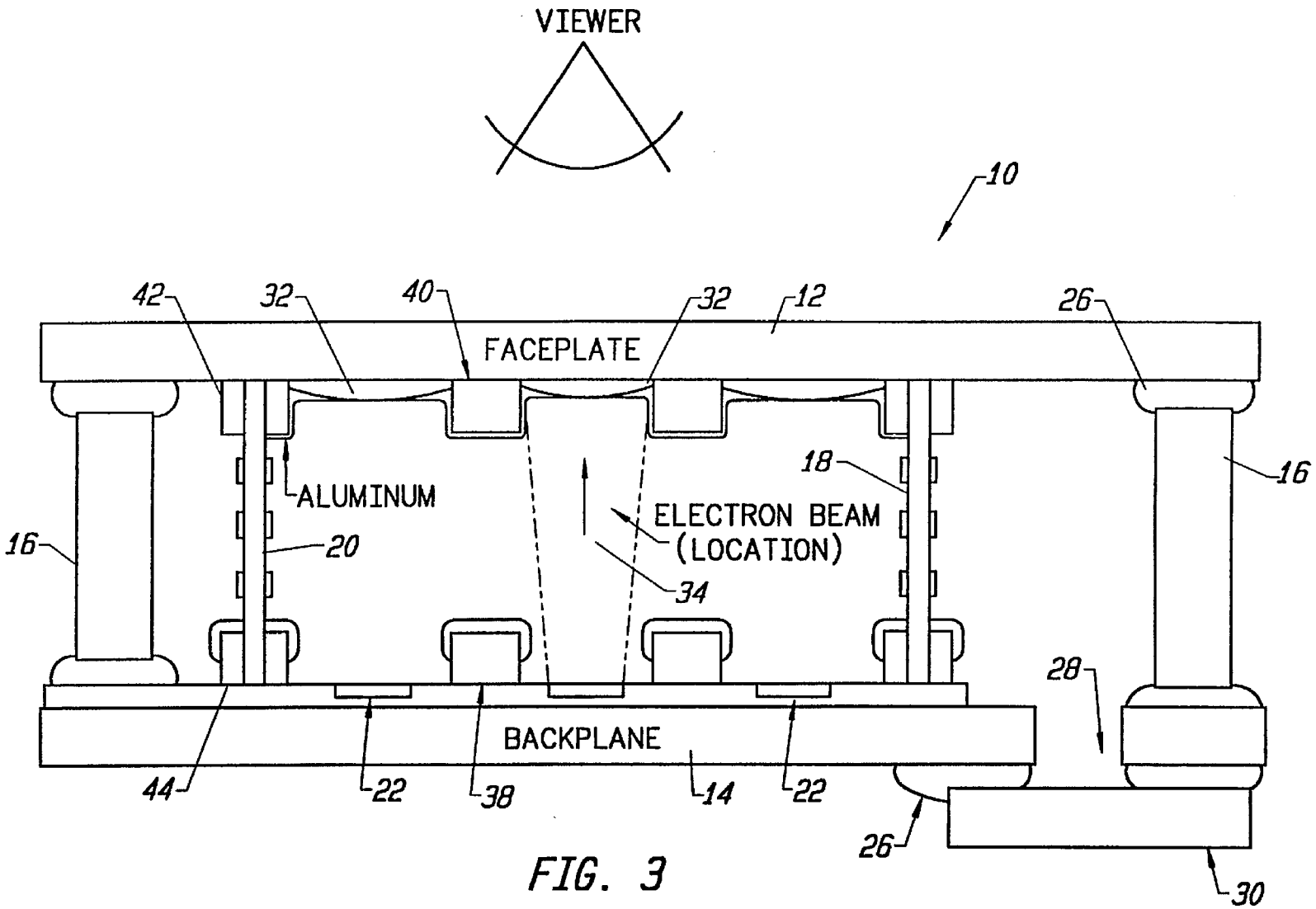
FIG. 3 is a cross-sectional view of the field emission display of FIG. 2.

Referring now to FIG. 3, faceplate 12 and backplate 14 consist of glass that is about 1.1 mm thick. A hermetic seal 26 of solder glass, including but not limited to Owens-Illinois CV 120, attaches side walls 16 to faceplate 12 and backplate 14 to create sealed envelope 18. The solder glass must withstand a 450 degree C. sealing temperature. Within envelope 18 the pressure is typically $10^{-8}$ torr or less. This high level of vacuum is achieved by evacuating envelope 18 through pump port 28 at high temperature to cause absorbed gasses to be removed from all internal surfaces. Envelope 18 is then hermetically sealed by a pump port patch 30.

Faceplate 12 includes pluralities of pixels. In order to provide good purity of color and high resolution, electrons emitted by field emitters 22 are directed to, and fall only on a corresponding plurality of pixels. An electron beam 34 from field emitters 22 is focussed and directed by a focus grid 38 to a color picture element comprised of a plurality of phosphors 32, and a black matrix 40 formed on an interior side of faceplate 12.

Various parameters are associated with the direction of electrons from field emitters 22 to the proper associated plurality of phosphor pixels 32. These include, 25 but are not limited to, (i) the precision of location of the field emitter 22 relative to focus grid 38, (ii) the precision of location of the plurality of phosphor pixels 32 relative to black matrix 40, and (iii) the alignment of focus grid 38 to black matrix 40. A light reflective layer, including but not limited to aluminum, is deposited on black matrix 40 and phosphor pixels 32 with a thickness of about 200 to 600 Å.

The ratio of area of the plurality of phosphor pixels 32 to black matrix 40 for a 10 inch diameter screen with color resolution of 640(×3)×480 picture elements is about 50%. The minimum width of black matrix 40 is therefore about 0.001 inches. This implies a maximum misalignment of electron beam 34 to the corresponding phosphor pixels 32 (from all contributors) to be less than half the maximum black matrix width (0.0005 inches) at any location of field emission device 10.

Field emission display 10 includes at least one internal structure in envelope 18 that fixes and constrains faceplate 12 to backplate 14, and thus aligns a plurality of phosphor pixels 32 with a corresponding sweet spot associated with the field emitters 22 to within a predetermined tolerance of 0.0005 inches or less. This internal structure is a wall gripper 42 formed on an internal side of faceplate 12, and 10, a locator 44 formed on an interior side of backplate 14. ! t will be appreciated that wall gripper 42 can be formed on backplate 14, and locator 44 can be formed on faceplate 12. A spacer wall 20 is mounted in wall gripper 42, and retained in locator 44. The most significant parameter of the alignment issue is the precision to which faceplate 12, e.g., black matrix 40 and phosphor pixels 32, is aligned to backplate 14, e.g., focus grid 38 and field emitters 22, and thereafter held in place without movement during the thermal assembly process. This is achieved with the internal structure in envelope 18 without the use of external fixturing devices.

Black matrix 40 is made of a photo-patternable material including but not limited to black chromium, POLYIMIDE, black frit, and the like. Both black matrix 40 and focus grid 38 are configured by photolithography. The phototooling to create black matrix 40 is substantially the same as the phototooling used to create focus grid 38, wall gripper 42 and locator 44.

Spacer walls 20 are first mounted in wall gripper 42. Thereafter, faceplate 12 and backplate 14 are locked together, to within the allowed tolerances, by positioning spacer walls 20 in corresponding locators 44.

Figure 4A:
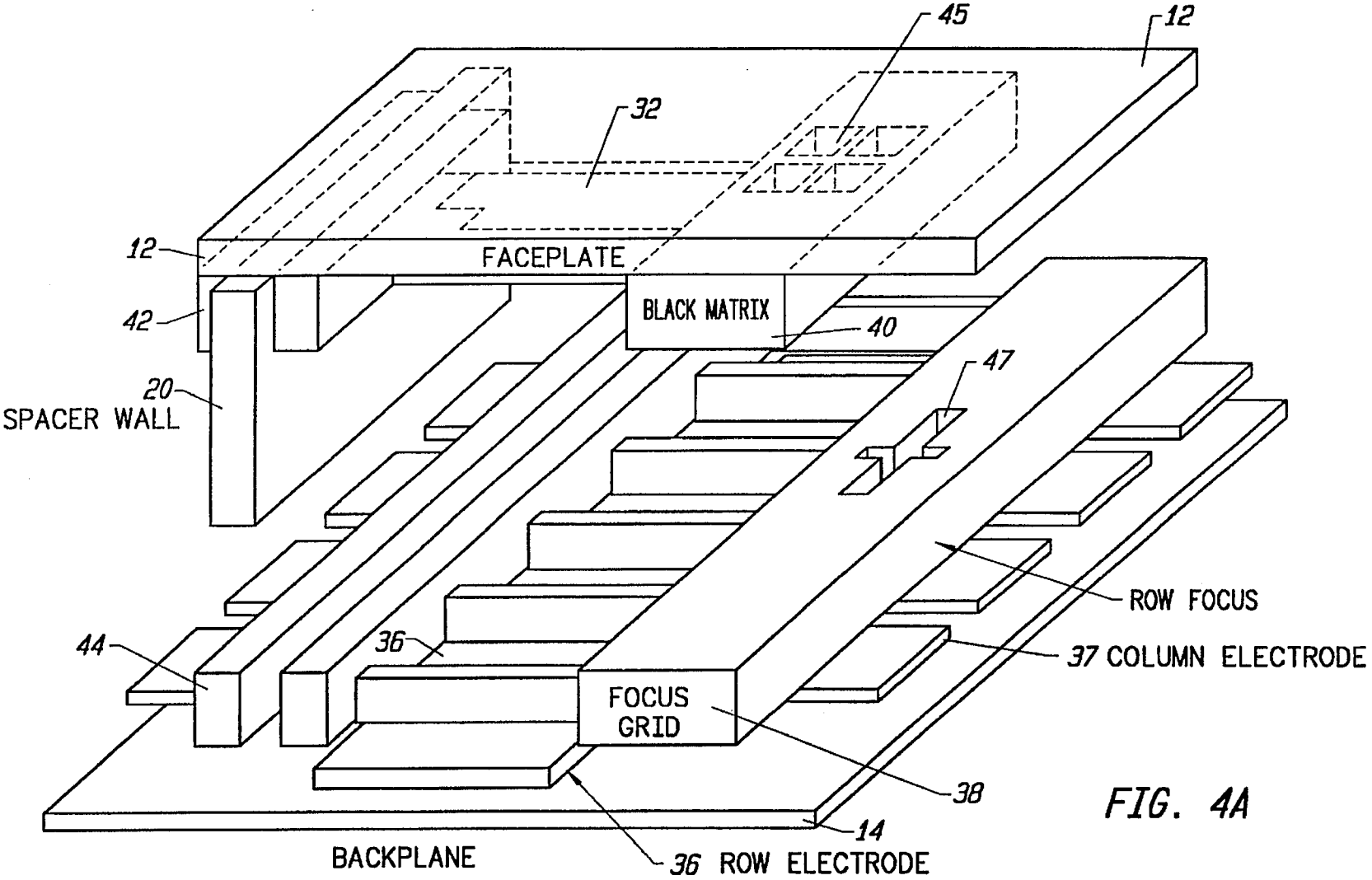
FIG. 4(*a*) is an exploded view of the field emission display with fiducials formed in the black matrix and the focus grid.
Figure 4B:
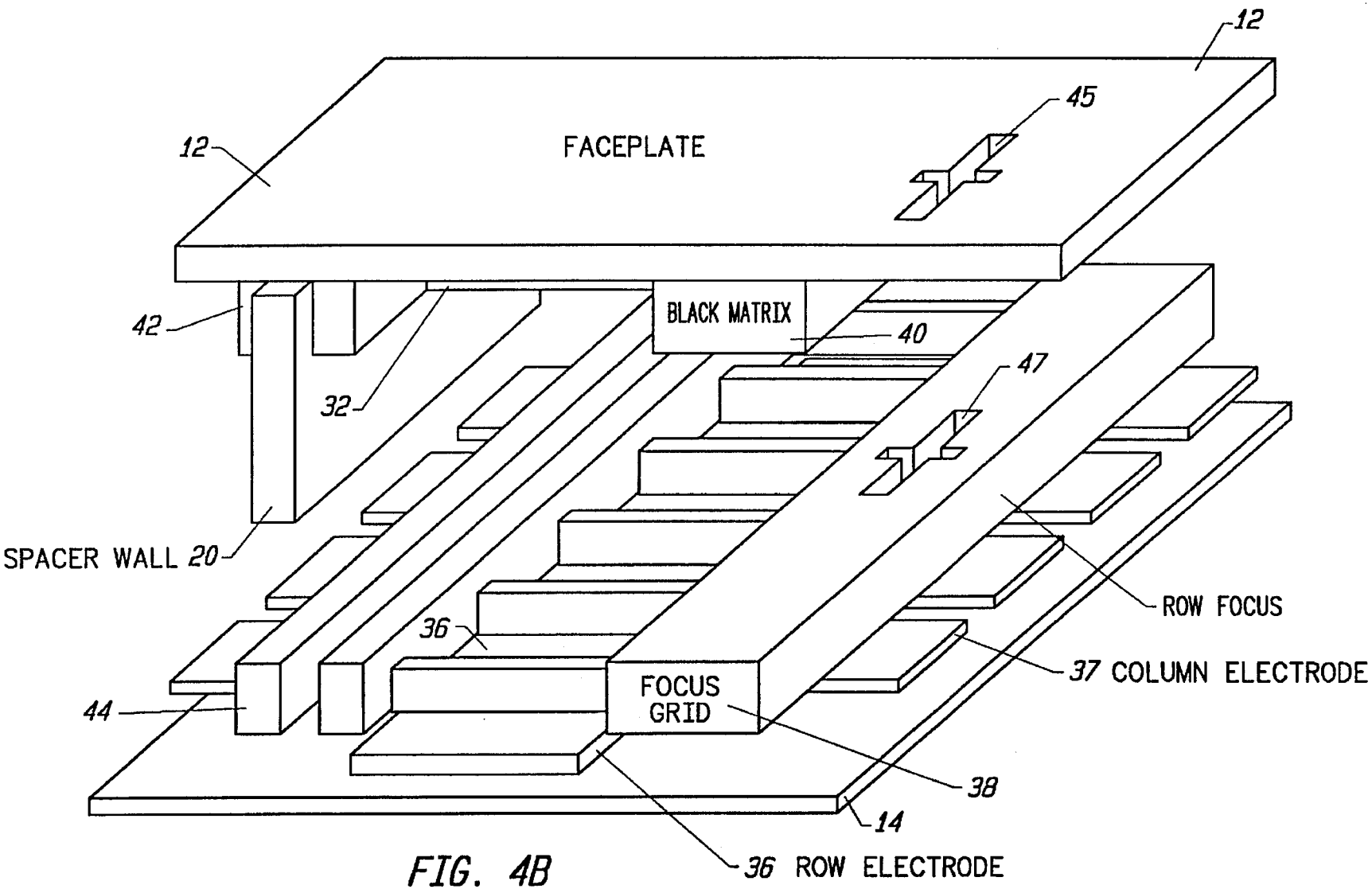

Referring now to FIGS. 4(*a*) and 4(*b*), alignment of faceplate 12 and backplate 14 is achieved with optical alignment fiducials 45 and 47, which can be integral to the structure of black matrix 40 and focus grid 38 respectively. Additionally, masks for fiducials 45 and 47 are integral to the phototooling, creating a geometric relationship between fiducial 45 and black matrix 40, and fiducial 45 and focus grid 38. Optionally, fiducials 45 and 47 can be on each of the substrates of faceplate 12 and backplate 14 respectively and not part of black matrix 40. In any event, fiducials 45 and 47 provide optical alignment of faceplate 12 to backplate 14, and of field emitters 22 to corresponding phosphor pixels 32. When fiducials 45 and 47 are in optical alignment, e.g., when collimated light falls on faceplate 12 which is transparent to the light, the image of faceplate alignment fiducial 45 is projected onto and maps to backplate fiducial 47. A shadow mask is provided to permit the passage of optical light through fiducials 45 and 47.

The mounted spacer walls 20 are physically strong and rigid enough to withstand atmospheric pressure, and maintain alignment of faceplate 12 and backplate 14 through the sealing and thermal processing of the display. The shape of wall gripper 42, as more fully described hereafter, is designed to grip spacer wall 20 tightly and retard its movement.

Figure 5:
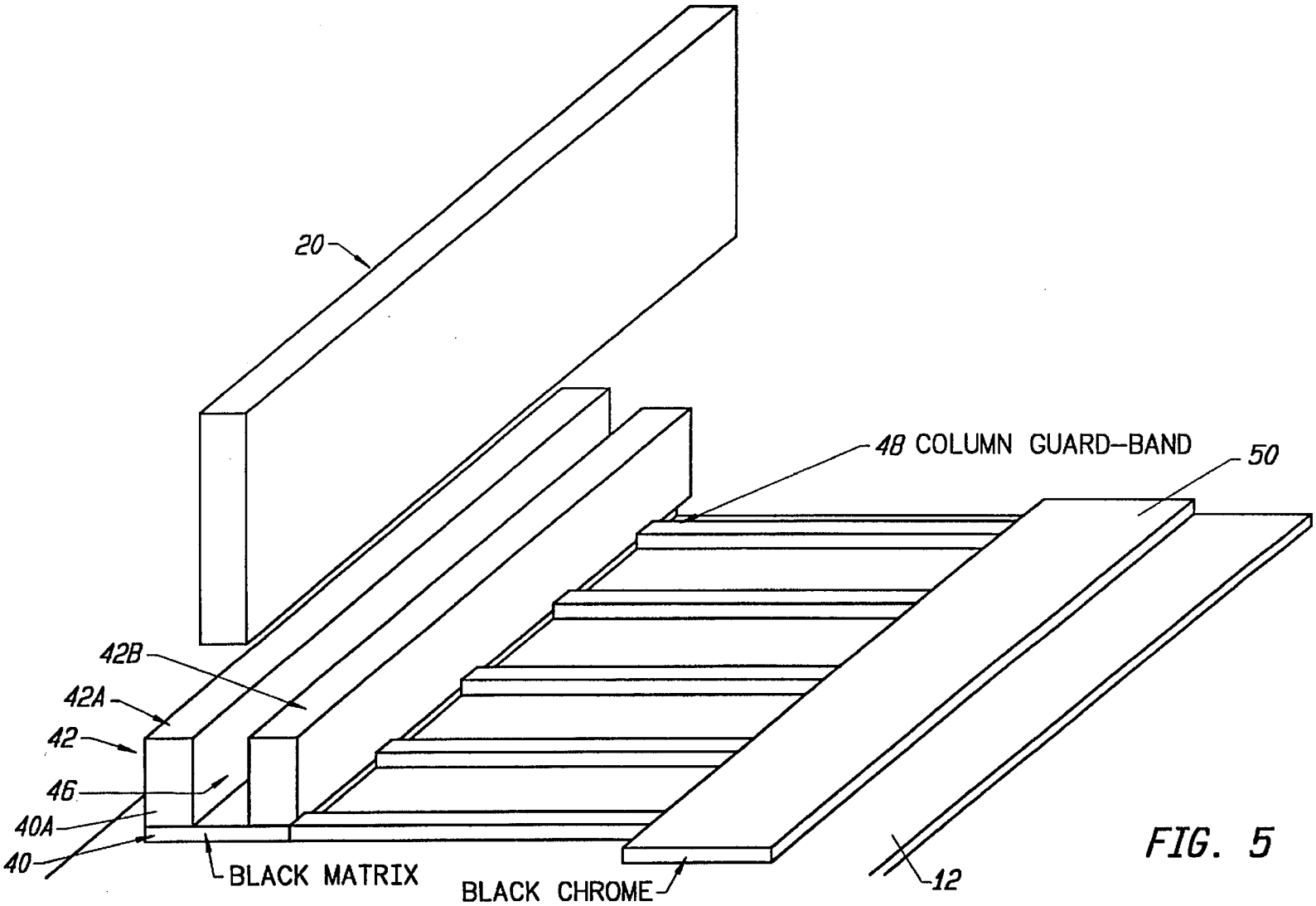
FIG. 5 is an enlarged perspective view of a spacer wall gripper formed at the interior side of the faceplate.

As shown in FIG. 5, black matrix 40 comprises column and row guard bands. Wall gripper 42 is formed on black matrix 40. Preferably, wall gripper 42 is formed in a column or row guard band. Wall gripper 42 has a height of about 0.001 inches or greater. A second layer of black matrix 40(a) is formed to create wall gripper 42, which is essentially a pair of raised structures 42(*a*) and 42(*b*), creating a receiving trench 46 for spacer wall 20. Wall gripper 42 is formed in a generally perpendicular direction in relation to a series of column guard bands 48. Wall gripper 42 is not visible or distinguishable from a row guard band 50 not constraining a wall gripper. When viewed at the exterior of faceplate 12, wall gripper 42 is not visible or distinguishable from row guard band 50, and thus has optical integrity. That is, the viewed footprint is the same for a row guard band 50 with a wall gripper 42 as that of a row guard band 50 without a wall gripper 42.

Figure 6B:
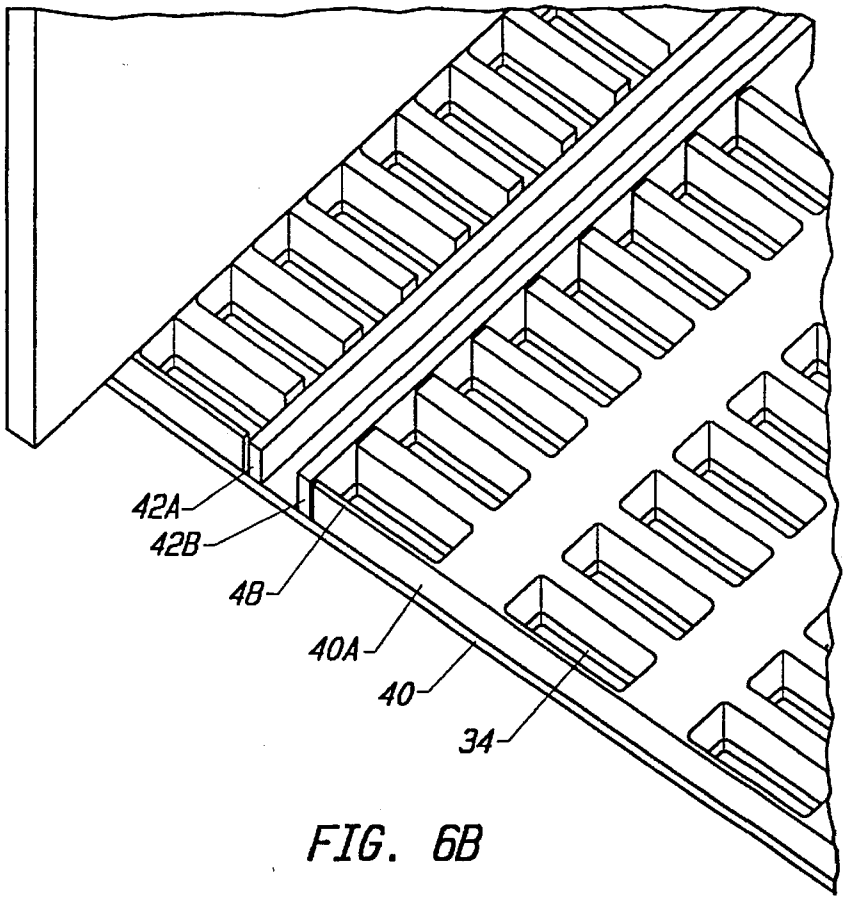
FIG. 6(*a*) is a perspective view of the spacer wall gripper and the pluralities of phosphor pixels.
Figure 6A:
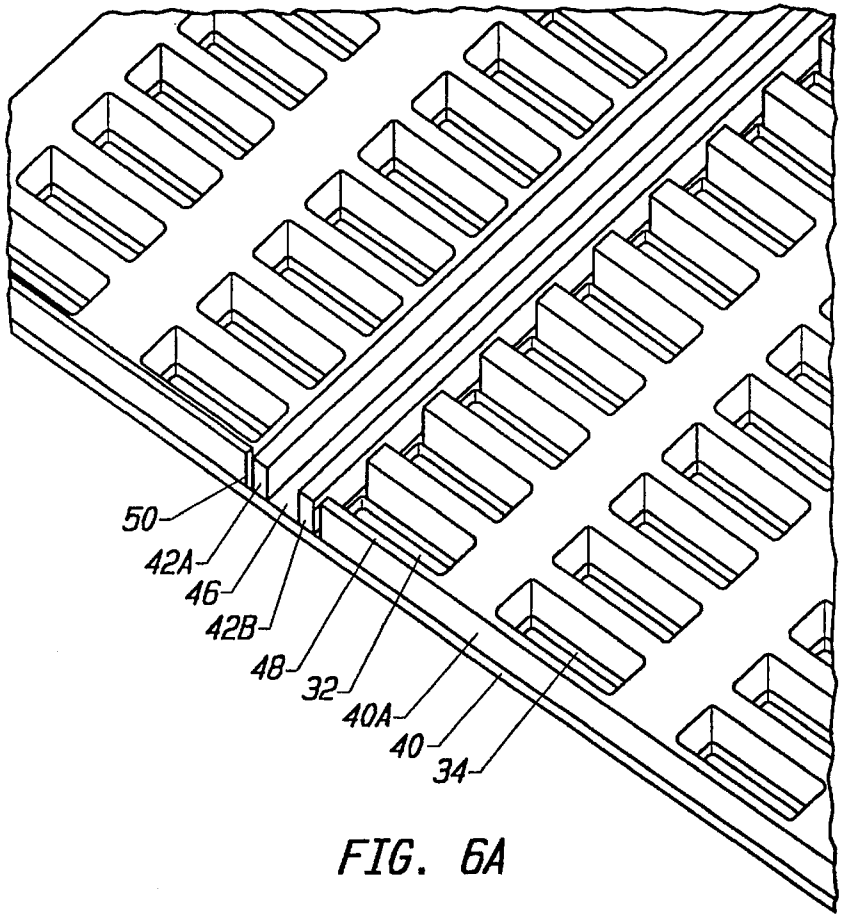

In FIG. 6(*a*), a first layer of black matrix 40 is formed, and then a second layer of black matrix 40(*a*) is created. Second layer 40(*a*) creates wall gripper 42, with the corresponding raised structures 42(*a*) and 42(*b*) defining a receiving trench 46. As illustrated, pluralities of phosphor pixels 32 are defined by black matrix 40 and second layer of black matrix 40(*a*). FIG. 6(*b*) illustrates the introduction of a spacer wall 20 into receiving trench 46.

Figure 7B:
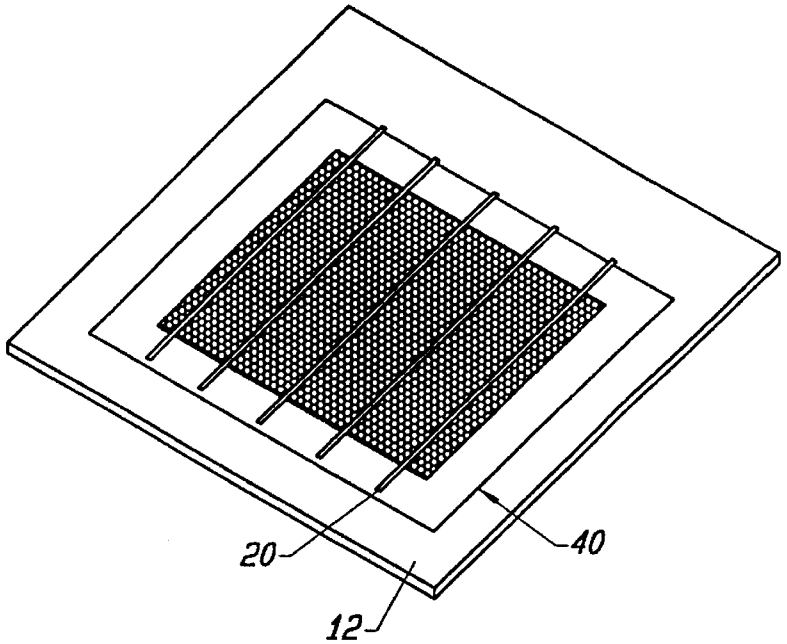
FIG. 7(*a*) is a perspective view of the spacer wall positioned in the receiving trench formed in the black matrix.
Figure 7A:
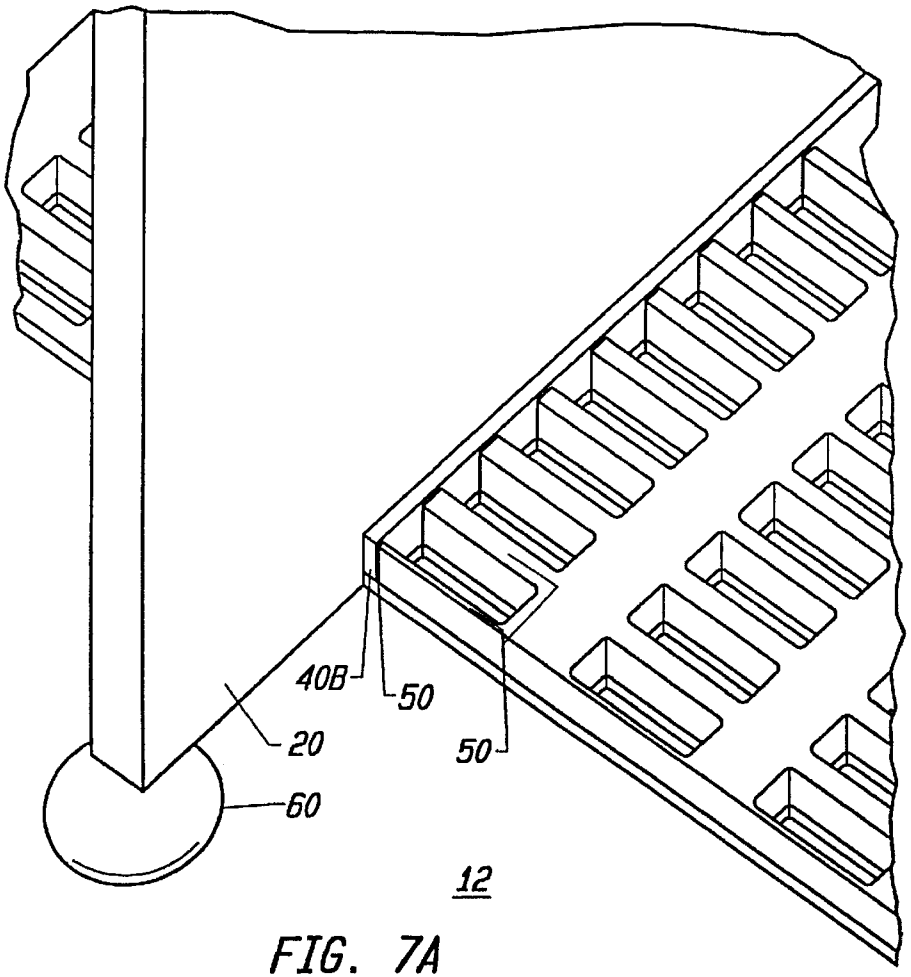

FIG. 7(*a*) illustrates spacer wall 20 positioned in receiving trench 46. In FIG. 7(*b*) a perspective view of an interior side of faceplate 12 shows black matrix 40 and five spacer walls 20 positioned in wall grippers 42.

The material forming wall gripper 42 is vacuum-compatible at processing temperatures in that it does not decompose or create gas contaminants. Processing temperatures are in the range of about 300 to 450 degrees C. Wall gripper 42 is sufficiently flexible (capable of local deformation) to permit spacer walls 20 to have greater thicknesses than receiving trench 46, and still be capable of insertion into receiving trench 46. Wall gripper 42 also provides a straightening effect on spacer walls 20. Wall gripper 42 is capable of sufficient local deformation to straighten spacer walls 20.

Figure 8:
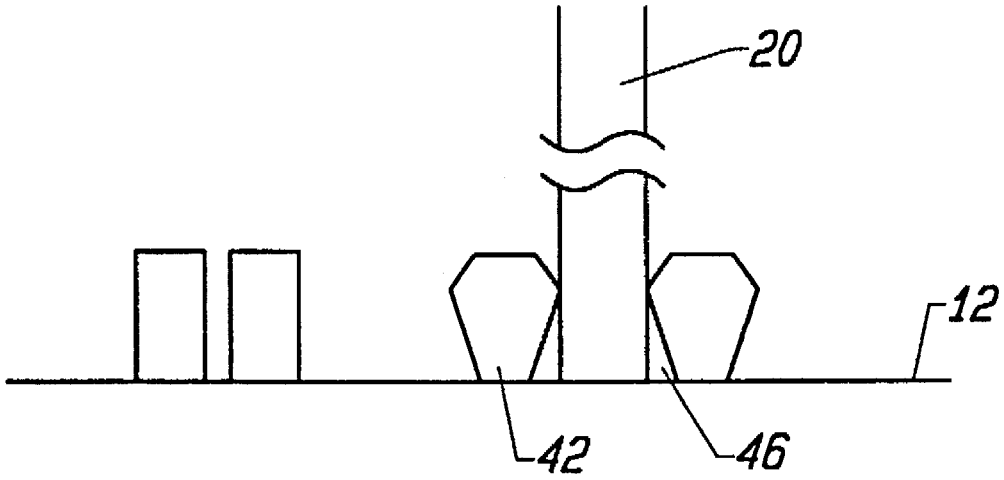
FIG. 8 is a cross-sectional view of a wall spacer in a receiving trench, and illustrates that the receiving trench is flared with a trapezoid geometry.
Figure 9A:
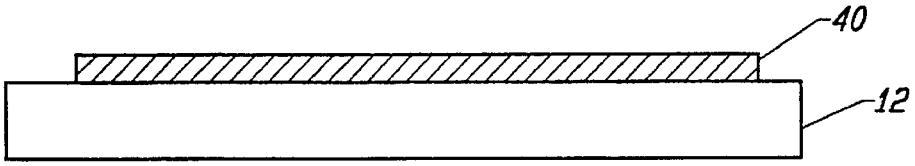
FIGS. 9*a*–9*e* illustrate a process for creating the wall gripper structure.
Figure 9B:
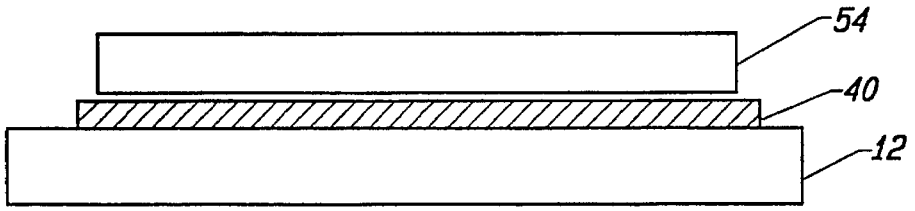
Figure 9C:
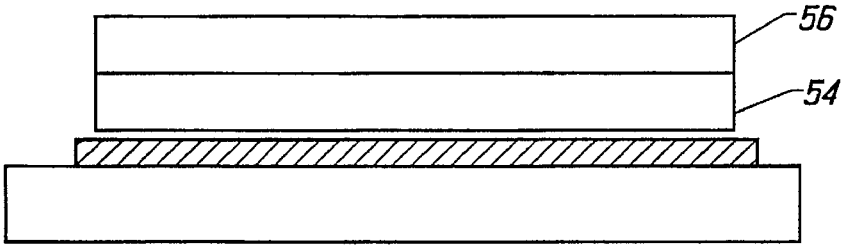
Figure 9D:
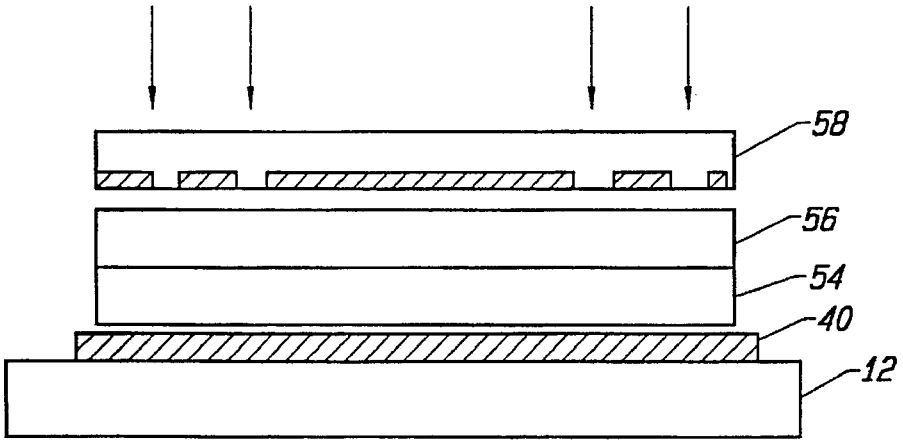
Figure 9E:
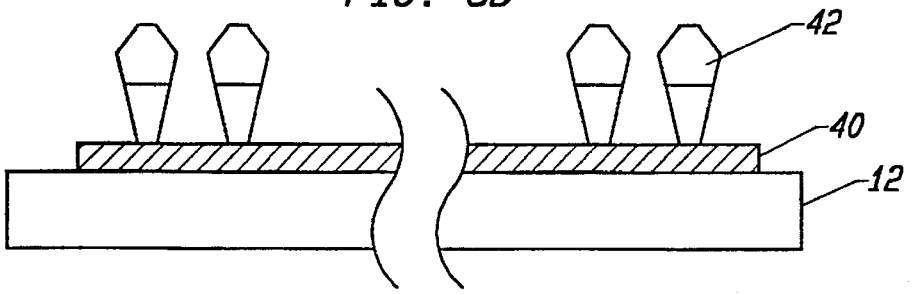
Figure 10A:
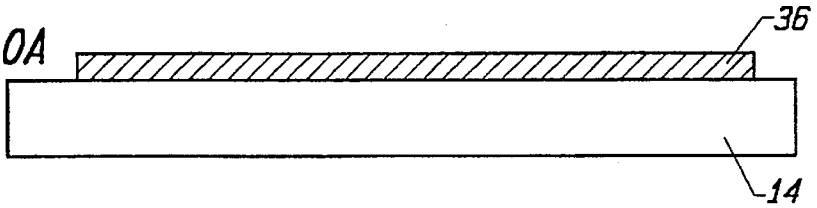
FIGS. 10*a*–10*e* illustrate a process for creating a locator formed on the interior side of the backplate.
Figure 10B:
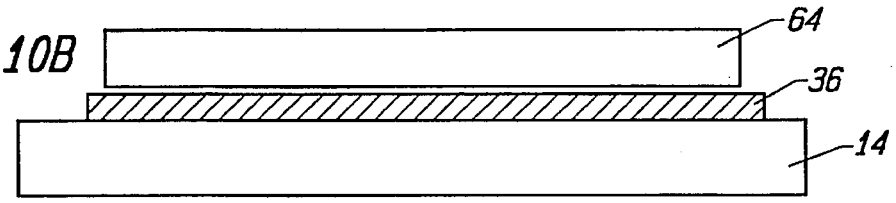
Figure 10C:
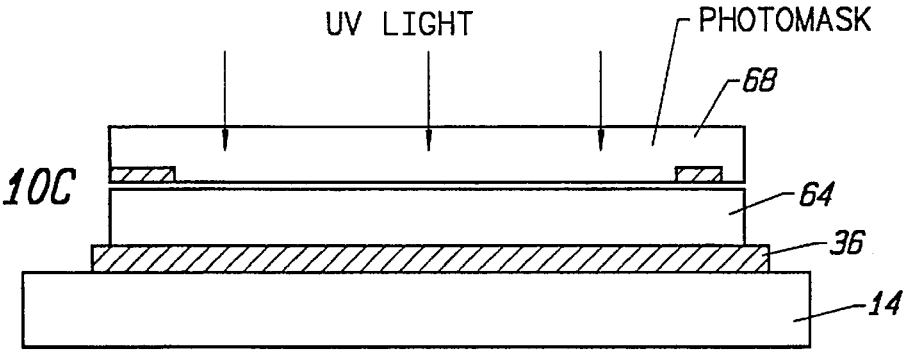
Figure 10D:
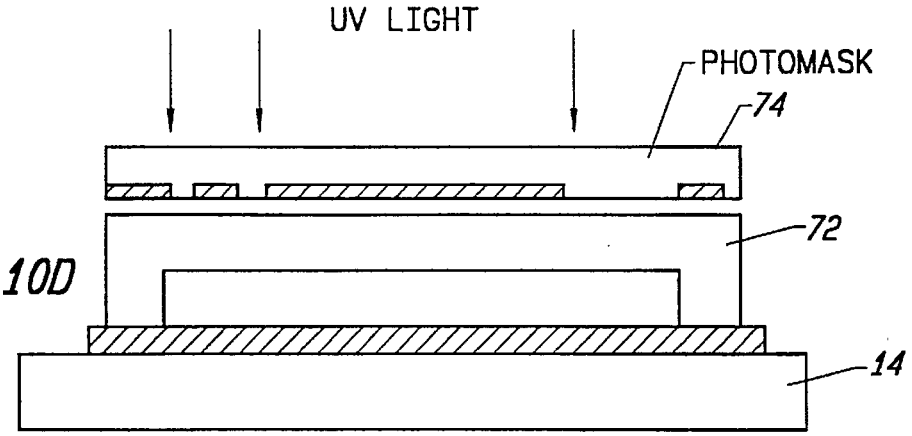
Figure 10E:
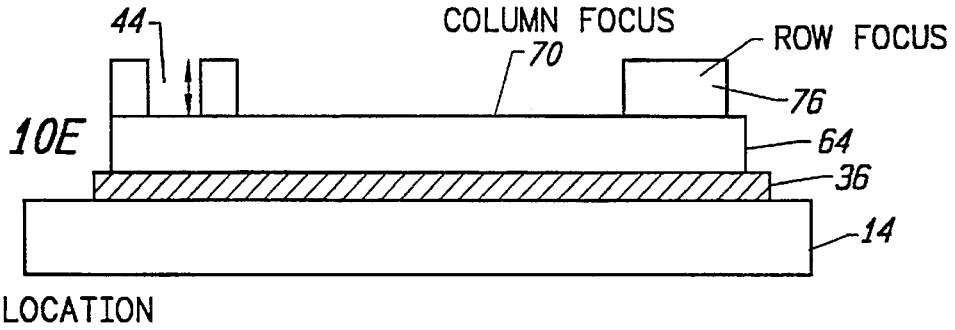

As shown in FIG. 8, wall gripper 42 has a receiving trench 46 geometry with a narrower aperture at the point of receiving a spacer wall 20, than the bottom of receiving trench 46. In one embodiment, the depth of receiving trench 46 can be about 0.002 inches.

One embodiment of the process for forming wall gripper 42 is now described, with reference to FIG. 9.

A preferred material for wall gripper 42 is a photodefinable POLYIMIDE, such as OCG PROBIMIDE 7020, or other similar polymers from DuPont, Hitachi and the like.

Black matrix 40 is created from black chromium and photopatterned by conventional lithography on faceplate 12. A first layer of PROBIMIDE 7020, denoted as 54, is deposited on black matrix 40 by conventional spin deposition at 750 RPM for 30 seconds. Faceplate 12 is then baked on a hot plate at 70 degrees C. for 6 minutes, followed by 100 degrees C. for twenty minutes, to drive off solvents.

A second layer of PROBIMIDE 7020, denoted as 56, is deposited and baked under the same conditions as layer 54. The soft baked PROBIMIDE 56 is then photoexposed with an exposure dose of 250 mJ/sq cm at 405 nm through a mask 58 in proximity to PROBIMIDE layer 56. Exposed Probimide layer 56 is then baked for 3 minutes at 100 degrees C., followed by a room temperature stabilization of 15 minutes. PROBIMIDE layer 56 at this time has an exposure energy profile that creates the trapezoid shape, illustrated in FIG. 8, that imparts the gripping function of wall gripper 42.

The PROBIMIDE is then developed in OCG QZ3501 by a puddle/spray cycle: [3 minutes puddle/1 minute, spray-repeat 1×] followed by a solvent rinse (OCG QZ 3512) for 1 minute. The developed wall gripper 42 is then hard baked for 1 hour at 450 degrees C. in a nitrogen atmosphere with a thermal ramp of 3 degrees C. per minute.

Spacer walls 20 are then inserted into wall gripper 42, as shown in FIG. 7(*a*). As illustrated, the insertion axis is perpendicular to the plane of faceplate 12. Insertion can also be accomplished parallel to the plane of faceplate 12 ( i.e. slide spacer wall 20 into receiving trench 46 from one end). Spacer wall 20 extends beyond black matrix 40 in an amount sufficient to secure one of its ends with solder glass 60 to substrate 12. Receiving trench 46 has one or more flared ends to facilitate spacer wall 20 insertion.

FIG. 7(*a*) shows spacer wall 20 in place with only one end secured by solder glass 60, or other high temperature adhesives. Other suitable adhesives include but are not limited to POLYIMIDE, and the like. Solder glass 60 can be, but is not limited to, OI CV 120. The assembly shown in FIG. 7(*a*) is then baked for one hour at 450 degrees C. to devitrify solder glass 60. A suitable oven ramp is 3 degrees C./minute. Securing one end of spacer wall 20 provides mechanical stability of spacer wall 20 for subsequent processing. Additionally, since there is differential expansion and contraction during thermal processing, when spacer walls 20 are secured or pinned at both ends buckling of spacer wall 20 results. Securing spacer wall 20 at only one end enables the use of materials with substantially different coefficients of thermal expansion for spacer walls 20, faceplate 12 and backplate 14, because all differential movement of spacer wall 20 is along the axis of receiving trench 46.

It will be appreciated that the present invention is not limited to the preceding example of a process cycle. The present invention can be created with various modifications of this process cycle.

As shown in FIG. 3, spacer wall 20 is fixed and constrained by wall gripper 42 and locator 44, and then once faceplate 12 and backplate 14 are optically aligned, spacer wall 20 is fixed and constrained in locator 44. Backplate 14 of display 10 is constructed to provide correspondence of features with faceplate 12 so that field emitters 22 communicate with the corresponding plurality of phosphor pixels 32, and wall gripper 42 is in optical alignment with locator 44. Wall locator 44 is formed by phototooling compatible with the tooling set used to create wall gripper 42, black matrix 40 and focus grid 38. Focus grid 38 is self aligned to field emitters 22.

Field emitters 22 are fabricated in a gate conductor electrode. This region is geometrically centered in a gate conductor. The gate conductor then acts as an integral photomask when light is transmitted from an external side of backplate 14. The transmitted light photopolymerizes a suitable light sensitive medium deposited on the interior surface of backplate 14. Focus grid 38 is aligned with the arrays of field emitters 22. The focus pattern is made conductive and then electrically isolated from other electrical conductors on backplate 14.

Backplate 14 has an exterior side and an interior side. Row and column electrodes 36 and 37 are formed on the interior side of backplate 14. Backplate 14 includes a transparent substrate. The row electrodes 36 are substantially transparent to UV radiation either due to their shape or to optical properties of the electrode material. A dielectric is disposed between the column and row electrodes 37 and 36. The column electrodes are opaque to uv light. It will be appreciated that the functions of the column and row electrodes 37 and 36 can be interchanged. Self alignment can be in the direction of the row or column electrodes 36 and 37. The more significant alignment is to the electrode that separately addresses color subpixels, since this determines color purity.

referring now to FIG. 10. A layer of a photo patternable material, including but not limited to POLYIMIDE, is formed over the row and column electrodes 36 and 37 on the inside surface of backplate 14. A photomask is positioned facing the interior side of backplate 14. The photomask is aligned to fiducial 47. The photo patternable material is then exposed through the mask. This creates the photo polymerized image of a row pattern that aligns to the row electrodes 36. Then there is an exposure from the exterior of faceplate 14, the opaque column electrodes 37 being used as an integral photomask. The polymer structure is developed creating a self aligned focus grid.

Figure 11:
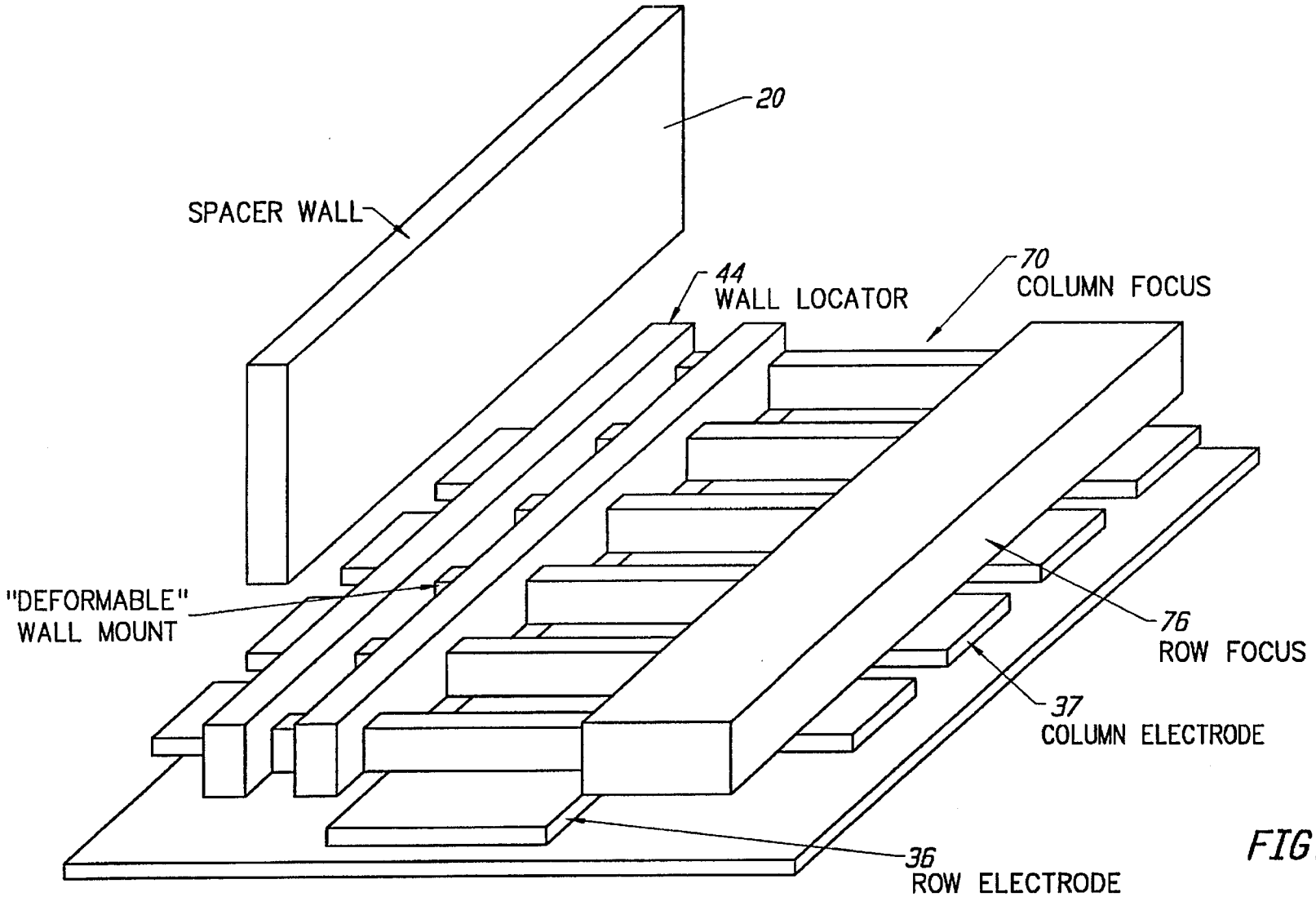
FIG. 11 is a perspective view of the backplate.
Figure 12A:
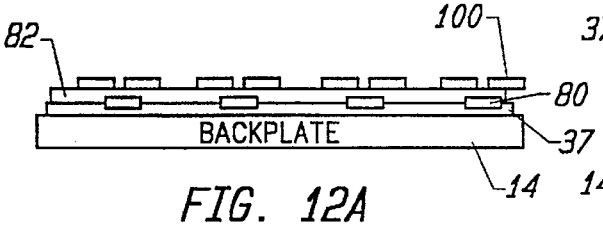
FIGS. 12*a*–12*j* illustrate a process for creating the focus grid structure on the backplate.
Figure 12G:
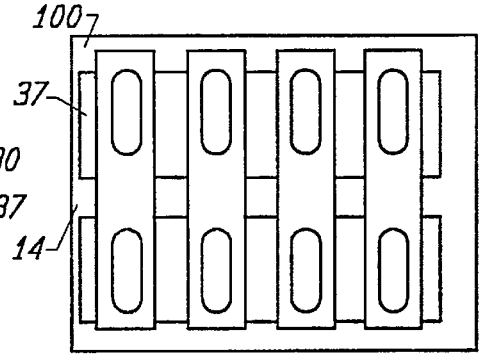
Figure 12B:
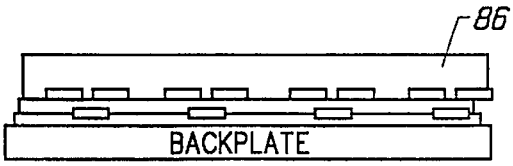
Figure 12H:
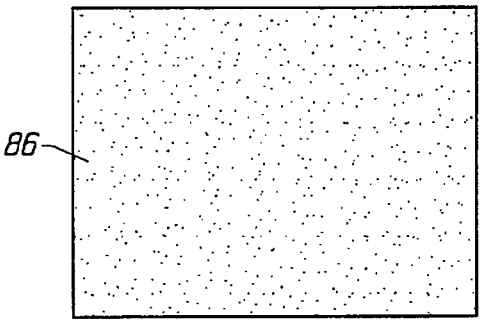
Figure 12C:
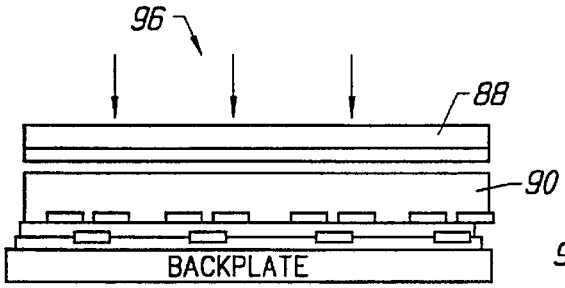
Figure 12I:
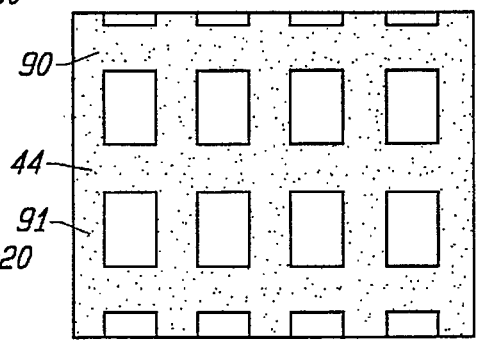
Figure 12D:
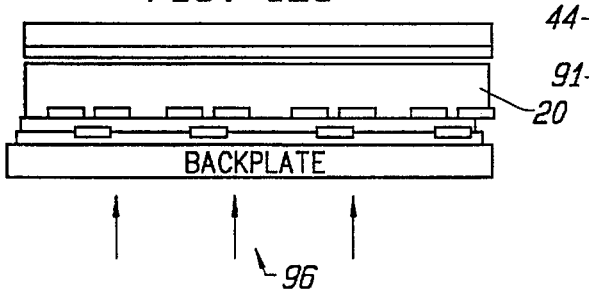
Figure 12E:
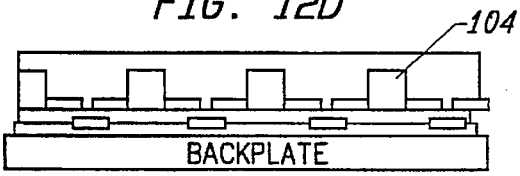
Figure 12F:
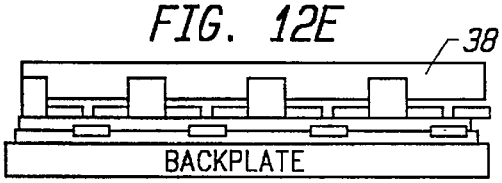
Figure 12J:
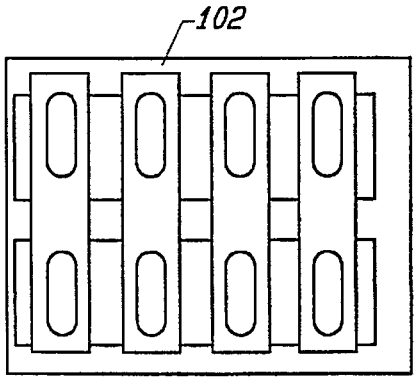

Self alignment is achieved with, (i) row and column electrodes 36 and 37 where one is transparent and the other opaque, and (ii) uv exposure from the front and back of transparent backplate 14. Referring now to FIG. 11, a deformable wall mount is defined by a plurality of deformable ribs that run orthogonal to wall locators 44.

With reference now to FIG. 12 backplate 14 consists of a glass substrate and adjacent row conductor pattern 78 substantially transparent to light in the wavelength range of 350 μm to 450 μm. Adjacent to row electrode pattern 78 and aligned to it is a pattern of resistors/emitters 80 opaque to light in the wavelength range. Resistor/emitter pattern 80 is disposed in a layer of dielectric 82 substantially transparent to light in the said wavelength range.

A pattern of gate electrodes is disposed, orthogonal to the pattern of row electrodes 78.

The gate electrode contains apertures 84, which are not opaque, centered in the geometry of conductor pattern 78 so that the aperture pattern centers are concentric with a center of the long axis of the conductor.

The aperture pattern is of size smaller than the size of the emitter/resistor so that when the gate electrode pattern is overlayed on the emitter pattern, the alignment is not critical. Thus, field emitter 22 is centered between the edges of the gate conductor electrode.

A layer of photosensitive polymer 86 is deposited over the gate electrode pattern to a dry-film thickness of up to 100 μm. The preferred polymer is OCG Probimide 7020.

Deposition of the PROBIMIDE is by conventional spinning process in two steps:

1. Dispense PROBIMIDE and spin for 10 seconds at 750 rpm.
2. Soft-bake for 6 minutes at 70 degrees followed by 10 minutes at 100 degrees.
3. Repeat steps 1.2.
4. Using photomask 88 expose PROBIMIDE to UV light 96 with a dose of 250 mJ/sq cm to define row focus electrode pattern 90. Pattern 90 is optically aligned to the row conductor pattern 78 so as to create row focus electrode pattern 90 lying substantially in the regions between row electrodes 36. The alignment in this axis is not critical and does not require self-alignment.
5. Without developing the previously exposed row focus pattern 90, expose the backplate substrate 14 to light 96 which transmits light through row conductor pattern 78, and dielectric 82 to expose PROBIMIDE in the regions 98 lying between opaque gate electrodes 100. Light also will be blocked by resistor 80 opaque to light 96. Exposure is with a dose of 120 mJ/sq cm.
6. Photomask 88 also incorporates wall locator 44 features in the row focus electrode pattern 90 so as to provide alignment of spacer wall 20, and hence the black matrix/phosphor pixel-pattern relative to the focus pattern.
7. The latent focus pattern is developed by puddle/spray in OCG QZ 3501 for 3 minutes to form pattern 102. Pattern 102 contains: Row and column focus dielectric, as well as wall locator trench 44. Wall locator trench 44 is formed by differential exposure of the row and column focus pattern so that the column focus pattern is shorter than row focus pattern. The preferred difference in height is 4 μm to 6 μm (after cure). This provides a detent for locating spacer wall 20 (FIG. 11).

A metal film 104 is deposited on the row and column pattern to provide conductivity on the tops and side of the pattern. This conductivity is required to create an optimum focusing electrode. The preferred metal is chromium deposited by conventional sputtered-deposition to a thickness of 100 Angstroms providing sheet resistivity <1000 ohms/sq.

Electrical isolation of the focus grid 38 from any column electrode is by oven bake at 450 degrees for one hour. This bake cycle cures the PROBIMIDE and causes it to shrink in all directions by approximately 50%. During baking the metallization adheres to the PROBIMIDE and consequently pulls back from the column metal to become electrically isolated.

The cured electrode thickness is 45 μm–50 μm to provide optimum focusing.

Consequently, faceplate 12 with spacer walls 20 attached, may be brought into proximity to backplate 14, and be manipulated in the (x,y,0) axes so as to bring spacer wall 20 into alignment with wall locator 44, and a respective plurality of phosphor pixels 32 into alignment with its corresponding field emitters 22. Faceplate 12 may then be translated along the z axis to cause spacer wall 20 to insert into wall locator 44. This assembly provides precision of alignment in the (x,y,0) axis and is held and maintained in position by the mechanically rigid structure formed by spacer walls 20, wall gripper 42 and locator 44. This structure may then be transported through a standard cycle of high temperature sealing and evacuation. Solder-glass may be used in the sealing process. This is done by baking at 450 degrees C. for one hour and using a 3 degree C./minute thermal ramp. The only fixturing required is to provide sufficient force to hold faceplate 12 and backplate 14 together to maintain contact. No external locating and aligning fixturing is required during thermal processing.

With reference now to FIGS. 10 and 11, a process for forming locator 44 on backplate 14 is illustrated beginning with backplate 14, row electrodes 36 and column electrode 37. Row and column metallization, together with gate oxide, electron emitter, gate metal (not shown), are formed on the interior surface of backplate 14.

A first layer 64 of OCG Probimide 7020 POLYIMIDE is deposited on backplate 14 to a dry thickness of 45 microns by conventional spinning means for 10 seconds at a spin speed of 750 rpm.

First layer 64 is soft baked in a two-step process for 6 minutes at a temperature of 79 degrees C. followed by 10 minutes at 100 degrees C. It is then exposed through a photomask 68 to define a column focus electrode 70. The exposure parameters are: UV light at wavelength from 350 to 450 nm for an exposure dose of 250 mJ/sq cm. The exposed pattern is then developed in OCG QZ 3501 developer for 3 minutes to form column focus electrode 70.

A second layer 72 of POLYIMIDE is deposited to a dry thickness of 20 microns and exposed through a second photomask 74 using the same exposure and development parameters as first layer 64, to form row focus electrode 76 and locator 44. Locator 44 has a depth of about 10 μm.

The POLYIMIDE is imidized by baking at a temperature of 460 degrees C. in a nitrogen atmosphere for 1 hour.

Backplate structure includes electrically insulating backplate, a base electrode, an electrically insulating layer, metallic gate electrodes, field emitters positioned in gate electrodes, and focusing ridges positioned adjacent to gate electrodes.

The gate electrode lies on the insulating layer. The gate electrode is in the shape of a strip running perpendicular to the base electrode.

Field emitters contact the base electrode and extend through apertures in the insulating layer. The tips, or upper ends, of field emitters are exposed through corresponding openings in the gate electrode. Field emitters can have various shapes, including but not limited to cones, filament structures, and the like. Focusing ridges generally extend to a considerably greater height above the insulating layer than the gate electrode. Preferably, the average height of focusing ridges is at least ten times the average height of a gate electrode. Typically, the height of focussing ridges is about 20 to 50 μm.

Field emitters emit electrons at off-normal emission angles when a gate electrode is provided with a suitably positive voltage relative to the field emitter voltage. Emitted electrons move towards phosphor pixels. When struck by these electrons, phosphor pixels emit light.

Focusing ridges influence trajectories in such a way that the one-to-one correspondence of phosphor pixels to field emitters is maintained. The phosphors are struck by substantially all of the emitted electrons.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A backplate structure for a field emission display, comprising:

a transparent backplate substrate;

at least two opaque electrodes;

a plurality of field emitters formed in and electrically coupled to the opaque electrodes;

a plurality of spacer wall locators formed on an interior side of the backplate;

a plurality of deformable ribs positioned in the wall locators in a direction orthogonal to the wall locators; and a focusing electrode in a surrounding relationship to field emitters, the focusing electrode including an exterior surface and a conductive cover disposed substantially over the exterior surface, wherein the opaque electrodes are positioned between the backplate substrate and the exterior surface of the focusing electrode.

2. The backplate structure of claim 1, wherein the opaque electrodes comprise parallel electrodes.

3. A backplate structure for a field emission display, comprising:

a transparent backplate substrate;

at least two opaque electrodes;

a plurality of transparent electrodes that are orthogonal to the opaque electrodes;

a plurality of field emitters formed in and electrically coupled to the opaque electrodes;

a plurality of spacer wall locators formed on an interior side of the backplate;

a plurality of deformable ribs positioned in the wall locators in a direction orthogonal to the wall locators; and a focusing electrode in a surrounding relationship to the plurality of field emitters, aligned to the opaque electrodes and electrically isolated from the opaque electrodes and the transparent electrodes, the focusing electrode including an exterior surface and an electrically conductive layer positioned substantially over the exterior surface, wherein the opaque electrodes and the transparent electrodes are positioned between the backplate substrate and the exterior surface of the focusing electrode.

4. A backplate structure for a field emission display, comprising:

a transparent backplate substrate;

at least two opaque electrodes;

a plurality of transparent electrodes that are orthogonal to the opaque electrodes;

a plurality of field emitters formed on and electrically coupled to the opaque electrodes;

a focusing grid in a surrounding relationship to the plurality of field emitters, aligned to the opaque electrodes and electrically isolated from the opaque electrodes and the transparent electrodes, the focusing grid including an exterior surface and an electrically conductive layer positioned substantially over the exterior surface, wherein the opaque electrodes and the transparent electrodes are positioned between the backplate substrate and the exterior surface of the focusing grid.

5. The backplate structure of claims 3 or 4, further comprising:

at least one alignment fiducial formed on the opaque or transparent electrodes.

6. A backplate structure for a field emission display, comprising:

a transparent substrate;

a plurality of opaque electrodes;

a plurality of transparent electrodes orthogonal to the opaque electrodes;

an active area defined by a plurality of field emitters formed on and electrically coupled to the transparent electrodes; and a focusing electrode in a surrounding relationship to the field emitters, aligned to the transparent electrodes and electrically isolated from the transparent electrodes and the opaque electrodes, the focusing electrode including an exterior surface and an electrically conductive layer positioned substantially over the active area, wherein the opaque electrodes and the transparent electrodes are positioned between the substrate and the exterior surface of the focusing electrode.

7. The backplate structure of claim 6 further comprising:

a plurality of spacer wall locators formed on an interior side of the backplate;

a plurality of deformable ribs positioned in the wall locators in a direction orthogonal to the wall locators.

8. The backplate structure of claim 6, wherein the transparent electrodes include opaque sections.

9. The backplate structure of claim 8, wherein the plurality of field emitters are formed on the opaque sections of the transparent electrodes.

10. A backplate structure for a field emission display, comprising:

a transparent backplate substrate;

a plurality of parallel opaque electrodes;

a plurality of parallel transparent electrodes that are orthogonal to the opaque electrodes;

an active area defined by a plurality of field emitters formed on and electrically coupled to the transparent electrodes;

a focusing grid in a surrounding relationship to the field emitters, aligned to the transparent electrodes and electrically isolated from the transparent electrodes and the opaque electrodes, the focusing grid including an exterior surface and an electrically conductive layer positioned substantially over the exterior surface, wherein the plurality of parallel opaque electrodes and the plurality of parallel transparent electrodes are positioned between the backplate substrate and the exterior surface of the focusing grid.

11. The backplate structure of claim 10, wherein each transparent electrode includes an opaque section.

12. The backplate structure of claim 11, wherein the plurality of field emitters are formed on the opaque sections of the transparent electrodes.

13. The backplate structure of claim 10 further comprising:

a plurality of spacer wall locators formed on an interior side of the backplate; and a plurality of deformable ribs positioned in the wall locators in a direction orthogonal to the wall locators.

14. A field emission display, comprising:

a faceplate substrate defining a faceplate interior side;

a plurality of phosphor pixels disposed on the faceplate interior side;

a transparent backplate substrate;

sidewalls combined with the faceplate substrate and the backplate substrate defining a display interior envelope that can be held at a vacuum;

a plurality of opaque electrodes;

a plurality of transparent electrodes that are orthogonal to the opaque electrodes;

a plurality of field emitters formed on and electrically coupled to the transparent electrodes;

a focusing electrode positioned in a surrounding relationship to the field emitters, aligned to the transparent electrodes and electrically isolated from the transparent electrodes and the opaque electrodes, the focusing electrode including an exterior surface and an electrically conductive layer positioned substantially over the exterior surface, wherein the transparent electrodes and the opaque electrodes are positioned between the backplate substrate and the exterior surface of the focusing electrode; and driver circuitry supplying current to the display.

15. The display of claim 14 further comprising:

a plurality of spacer wall locators formed on an interior side of the backplate;

a plurality of deformable ribs positioned in the wall locators in a direction orthogonal to the wall locators.

16. The display of claim 14, wherein the transparent electrodes include opaque sections.

17. The display of claim 16, wherein the plurality of field emitters are formed on the opaque sections of the transparent electrodes.

* * * * *